US012546577B2

(12) United States Patent
Odess et al.

(10) Patent No.: US 12,546,577 B2
(45) Date of Patent: Feb. 10, 2026

(54) PROJECTILE FOR A NON-LETHAL WEAPON

(71) Applicant: A.T. COBRA, Tzur Hadash (IL)

(72) Inventors: Aryeh Odess, Asael (IL); Tsuriel Admanit, Tzur Hadash (IL)

( * ) Notice: Subject to any disclaimer, the term of this patent is extended or adjusted under 35 U.S.C. 154(b) by 90 days.

(21) Appl. No.: 18/683,506

(22) PCT Filed: Aug. 15, 2022

(86) PCT No.: PCT/IB2022/057627
§ 371 (c)(1),
(2) Date: Feb. 13, 2024

(87) PCT Pub. No.: WO2023/017497
PCT Pub. Date: Feb. 16, 2023

(65) Prior Publication Data

US 2024/0353210 A1 Oct. 24, 2024

Related U.S. Application Data

(60) Provisional application No. 63/260,268, filed on Aug. 13, 2021.

(51) Int. Cl.
*F42B 10/06* (2006.01)
*F42B 33/02* (2006.01)

(52) U.S. Cl.
CPC ..... *F42B 10/06* (2013.01); *F42B 33/02* (2013.01)

(58) Field of Classification Search
CPC ..... F42B 10/06; F42B 33/02; F42B 33/00
See application file for complete search history.

(56) References Cited

U.S. PATENT DOCUMENTS 6,543,365 B1 * 4/2003 Vasel ..... F41B 11/62 102/370
2001/0045173 A1 * 11/2001 Gibson ..... F42B 10/24 102/513
2012/0199034 A1 * 8/2012 Gibson ..... F42B 12/40 102/517
2013/0337949 A1 * 12/2013 Macy ..... F42B 12/40 473/577
2014/0109790 A1 * 4/2014 Dannawi ..... F42B 8/12 102/502
2015/0144018 A1 * 5/2015 Buys ..... F41A 9/65 102/502
2016/0216089 A1 * 7/2016 Gibson ..... F42B 12/40
2020/0109931 A1 * 4/2020 Pedicini ..... F42C 11/065

* cited by examiner

*Primary Examiner* — Justin M Benedik
(74) *Attorney, Agent, or Firm* — Reches Patents

(57) ABSTRACT

A projectile for a non-lethal weapon, the projectile includes a hemispherical member; an inner element that comprises an inner aperture; a body that comprises a sidewall, wherein the sidewall comprises a front end that is adjacent to the hemispherical member and a rear end that is proximal to the hemispherical member; wherein the inner element is positioned between the front end and the rear end; wherein the inner aperture and the hemispherical member define a first inner space for receiving non-lethal material; and a closing element for closing the inner aperture.

21 Claims, 8 Drawing Sheets

10

100

PROJECTILE FOR A NON-LETHAL WEAPON

CROSS REFERENCE

This application claims the priority of U.S. provisional patent Ser. No. 63/260,268 filing date Aug. 13, 2021, which is incorporated herein in its entirety.

BACKGROUND OF THE INVENTION

The usage and especially the range of non-lethal rifles is limited due to the need not to kill the living target they hit.

US patent application US 2012/0199034 of Gibson illustrates a projectile that is made from a hemispherical member in a first portion of the projectile that is connected by glue to a sidewall member of the second portion of the projectile. The hemispherical member is filled with materials—through an opening that passes through an exterior of the projectile and of the hemispherical member. The opening faces the front of the projectile. The hemispherical member is glued to the sidewall member.

It has been found that the first portion may disconnect from the second portion—before firing the projectile—for example while the projectile is within a projectile cartridge. This may cause the non-lethal rifle to malfunction and/or may harm the carrier.

There is a growing need to provide improved projectiles for a non-lethal weapons.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

DETAILED DESCRIPTION OF THE DRAWINGS

Figure 1:
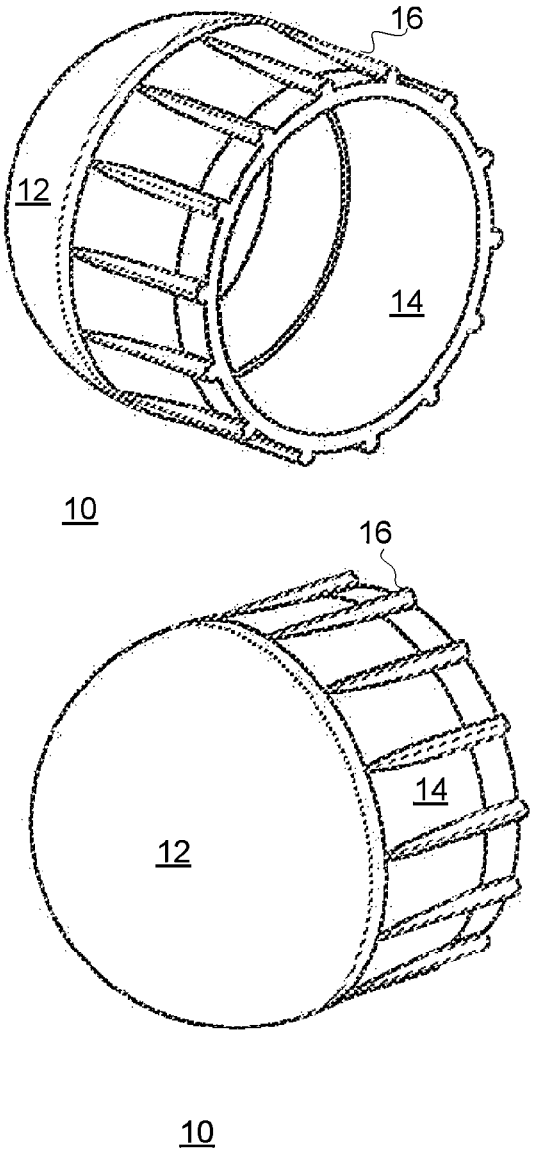
FIGS. 1-7 illustrate examples of projectiles and parts of the projectiles.
Figure 2:
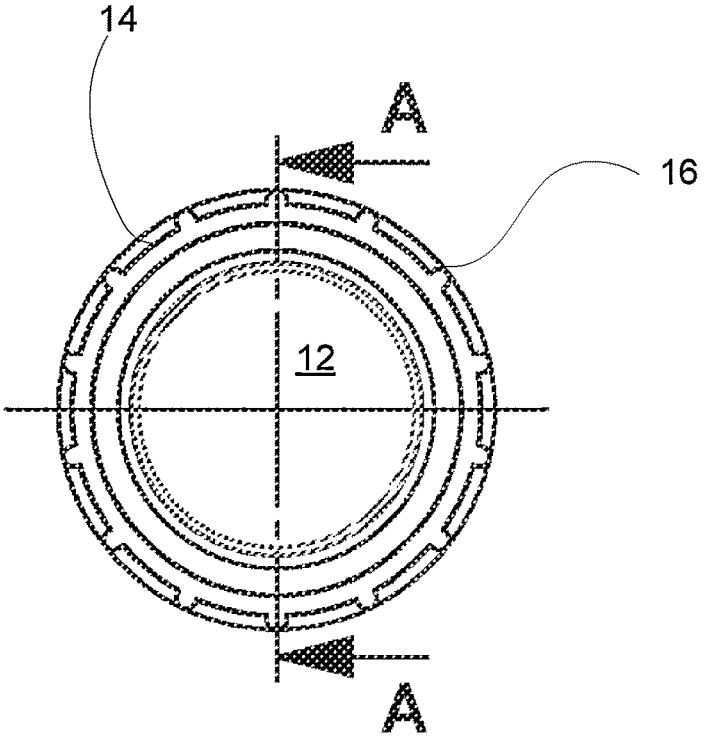
Figure 3:
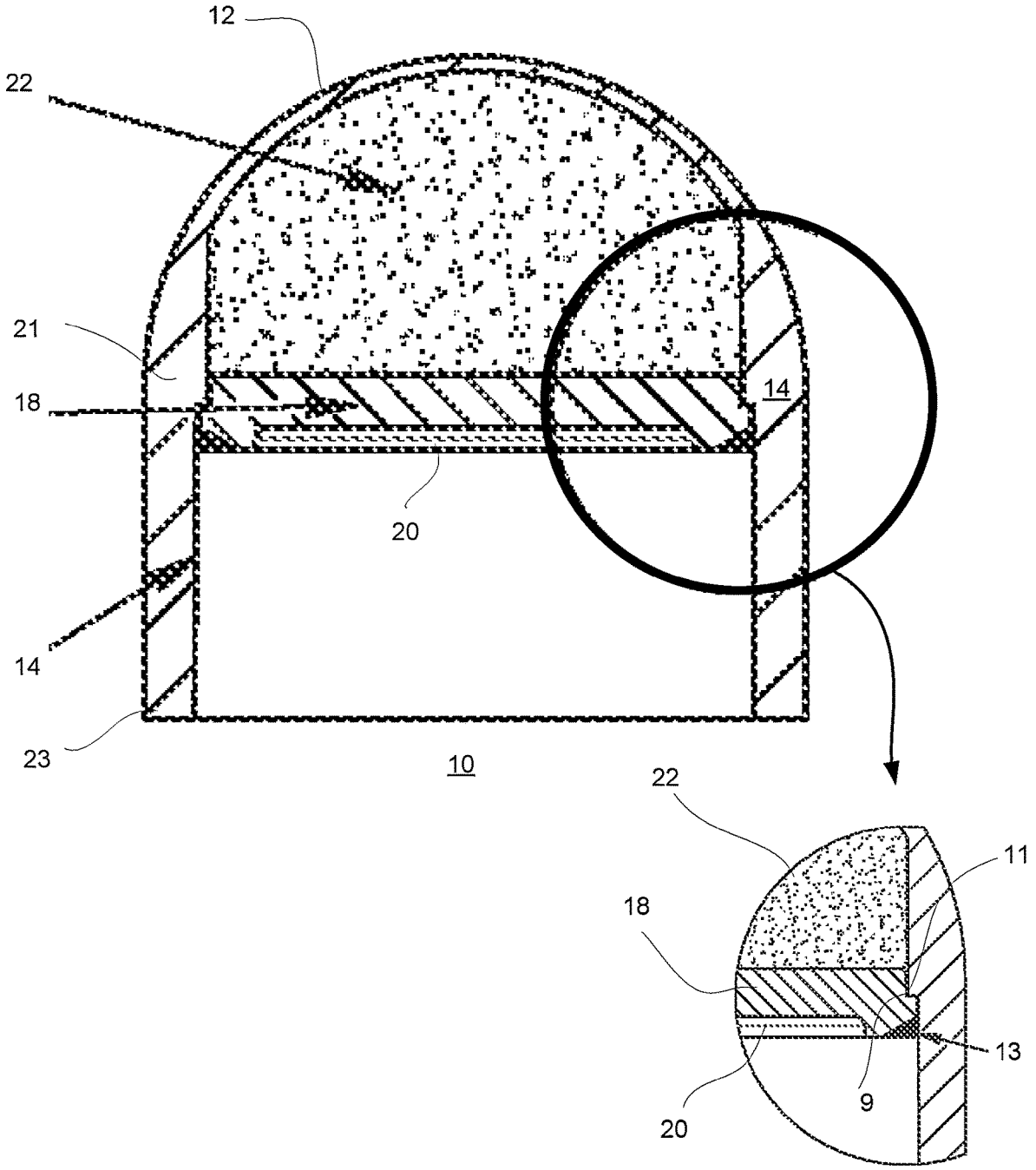
Figure 4:
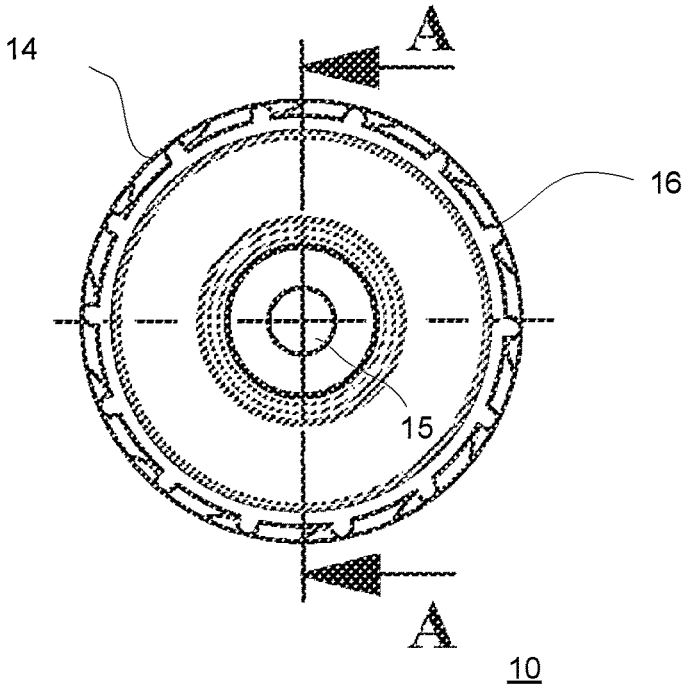
Figure 5:
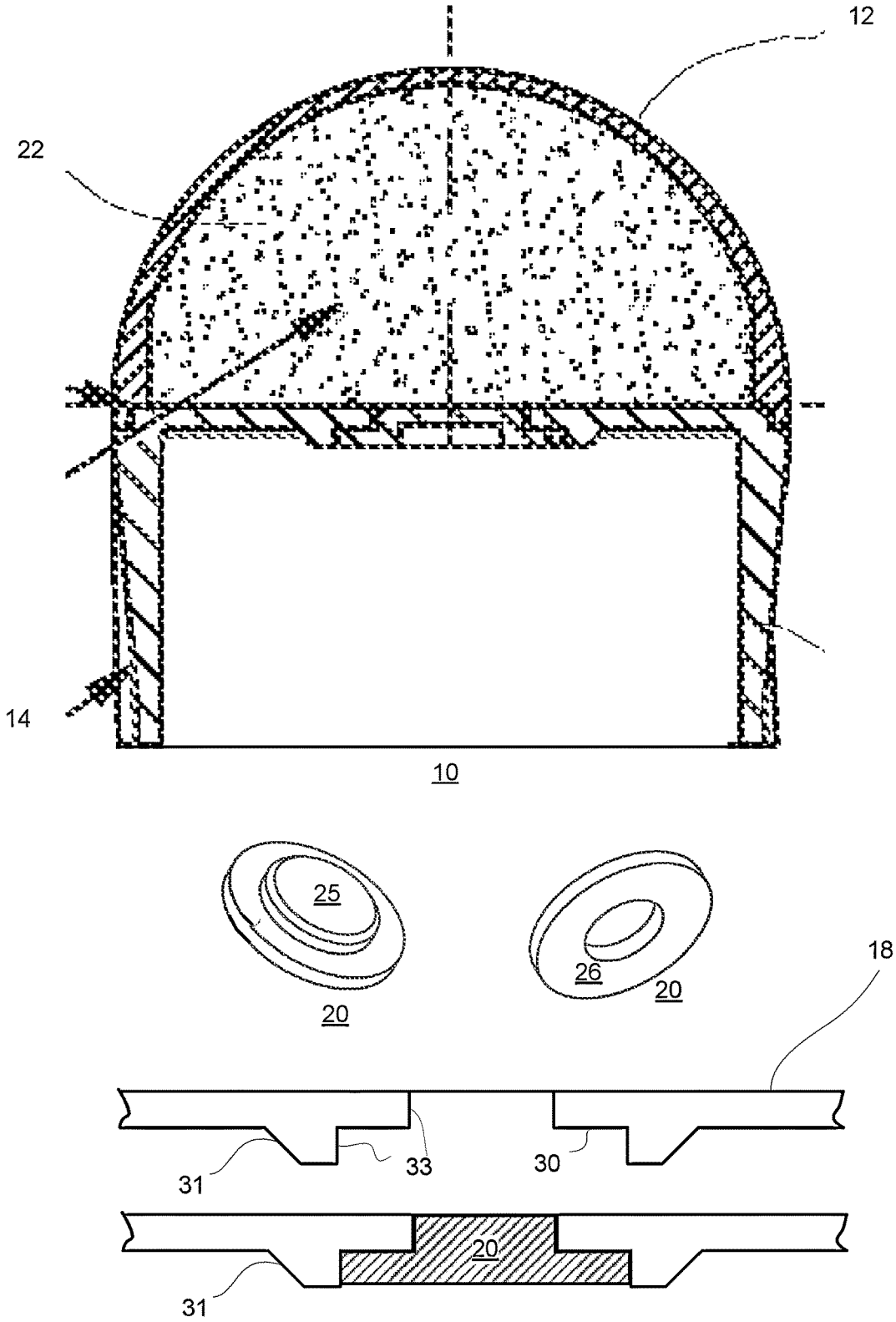
Figure 6:
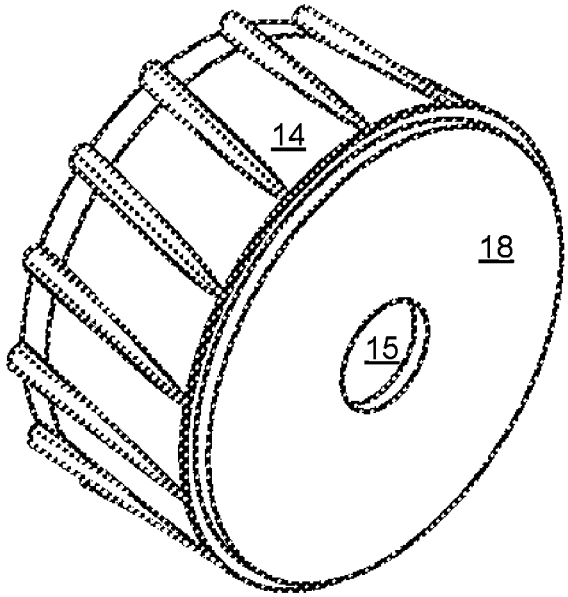
Figure 6:
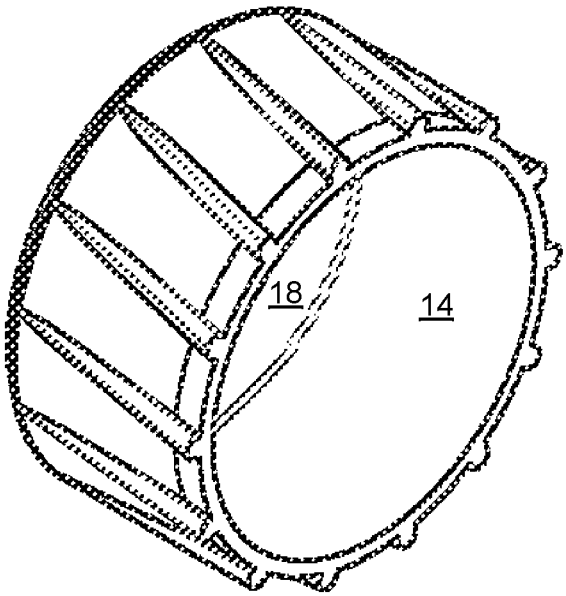

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

Because the illustrated embodiments of the present invention may for the most part, be implemented using electronic components and circuits known to those skilled in the art, details will not be explained in any greater extent than that considered necessary as illustrated above, for the understanding and appreciation of the underlying concepts of the present invention and in order not to obfuscate or distract from the teachings of the present invention.

Any reference to "comprising" and/or "comprises" and/or "including" should be applied mutatis mutandis to "consisting". Any reference to "comprising" and/or "comprises" and/or "including" should be applied mutatis mutandis to "consisting essentially of".

And/or—means additionally or alternatively. For example—A and/or B—means only A or only B or A and B.

Any reference to "may be" should be applied mutatis mutandis to "may not be".

There may be provided a projectile for a non-lethal weapon. Examples of the projectile (or parts of the projectile) are illustrated in FIGS. 1-7.

The projectile 10 may include a hemispherical member 12, an inner element 18 that may include an inner aperture 15, a body that may include a sidewall 14, and a closing element 20.

The inner aperture 15 is not an exterior aperture. The inner aperture is not a part of the exterior of the hemispherical member The inner aperture may be surrounded (at least in part—or fully surrounded) by the sidewall 14.

The sidewall may include a front end 21 that may be adjacent to the hemispherical member and a rear end 23 that may be proximal to the hemispherical member.

The inner element 20 may be positioned between the front end 21 and the rear end 23.

Figure 7:
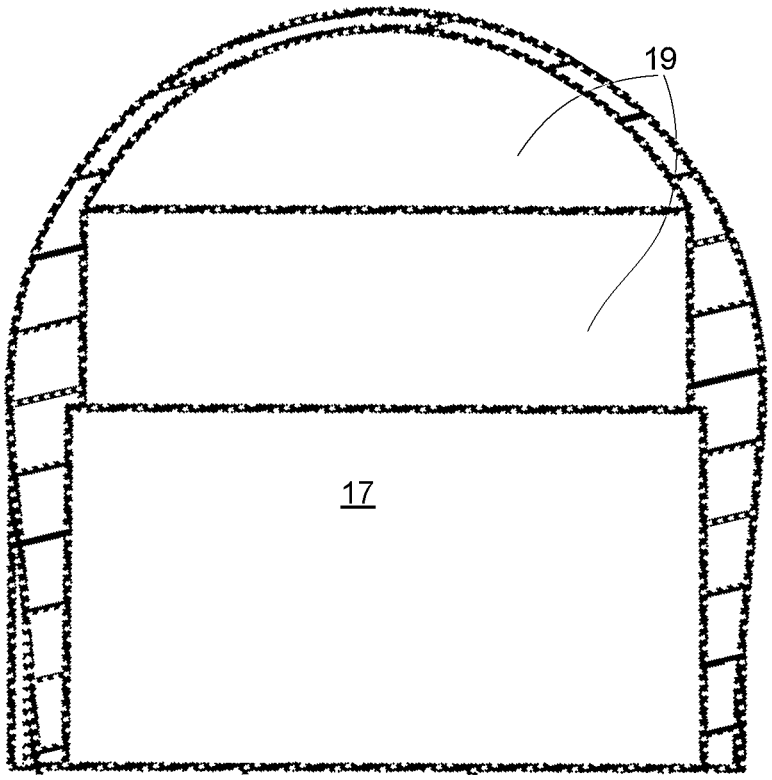

The inner element 18 may have a planar shape or any other shape. The inner element 18 and the hemispherical member 12 define a first inner space 19 for receiving non-lethal material. The first inner space may be followed by a second inner space 17 defined by the inner element and the sidewall. The second inner space 17 may be open ended or may be closed. FIG. 7 illustrates a staggered first inner element. Other shaped may be provided.

The projectile (an especially of using an internal aperture formed in an internal element) prevents the material to leak or to be distributed before the projectile is fired and hits the target.

The internal aperture 15 may be located after the non-lethal material 22—and in opposite direction to the propagation direction of the projectile. This may reduce the risk of having the material exiting the projectile (due to forces applied on the projectile when propagating towards the target)—during the propagation of the projectile.

The projectile may include the non-lethal material 22.

The read end may be open ended—or may be closed.

The front part (that part that faces the hemispheric member) of the closing element may have a stepped cross section. It may have other cross sections-cylindrical, bevel, and the like.

The inner aperture (the interior of the inner aperture) may also have a stepped cross section. See for example—FIG. 5 in which a stepped closing element 20 is located within the inner aperture.

The number of steps may be one, two, or more than two.

The front part of the closing element may be radially symmetrical.

The inner aperture may be radially symmetrical.

The interior of the hemispheric member may include an inner step 11 and wherein the inner element has a corresponding inner recess 9. The inner step may prevent slippage of the inner element towards the front of the hemispheric member The projectile may include fins extending from the sidewall. The fins may be oriented to the longitudinal axis of the projectile—or may be parallel to the longitudinal axis.

The closing element may be a cover. The closing element may fit the interior aperture. The cover may be stepped, may be radially symmetrical—or may have other shape and/or be asymmetrical. See for example the stepped cross section cover 30 of FIG. 5 that include an smaller disk 25 followed by a larger ring 26.

Using a cover instead of just inserting glue into the aperture makes the sealing more reliable and/or allows using a wider aperture—for speeding up the provision of the material to the projectile.

The inner element may include a closing element interface for interfacing with the closing element, wherein the closing element interface may be radially symmetrical. Interfacing may be in contact with the closing element or in contact with a glue that glues the closing element to the closing element interface.

The projectile closing element interface 30 may have a bevel exterior 31 and a stepped inner interior 33. Other shapes of the exterior and the interior may be provided.

The closing element, when attached to the closing element interface, may or may not exceed (extend out of) the closing element interface.

The hemispherical member may be connected to a body.

The hemispherical member may be integrated with the body.

The hemispherical member may be manufactured as a single part with the body.

The inner element may be an apertured cross member.

Non-limiting examples of dimensions are diameter—of the projectile 10-20 mm—especially between 16-17 mm, length of the projectile—between 10-20 mm—especially between 17 and 18 mm, thickness of the hemispherical member—at the top about 0.4 mm, thickness of the fins between 0.5-1 mm—especially 0.79 mm, thickness of the inner element between 0.04 and 0.1 mm-especially 0.06 mm, thickness of the sidewall—between 0.4 and 1 mm—especially 0.6 mm, thickness of the cover—between 0.7 and 1.5 mm-especially 1.1 mm, thickness of the larger disk between 0.3 and 0.7 mm—especially 0.5 mm, diameter of the exterior of the larger disk-between 5 and 6 mm.

The projectile for a non-lethal weapon, may be prepared by: (i) filling, through the inner aperture of the projectile, the first inner space of the projectile with non-lethal material; and (ii) closing the inner aperture with a closing element.

Figure 8:
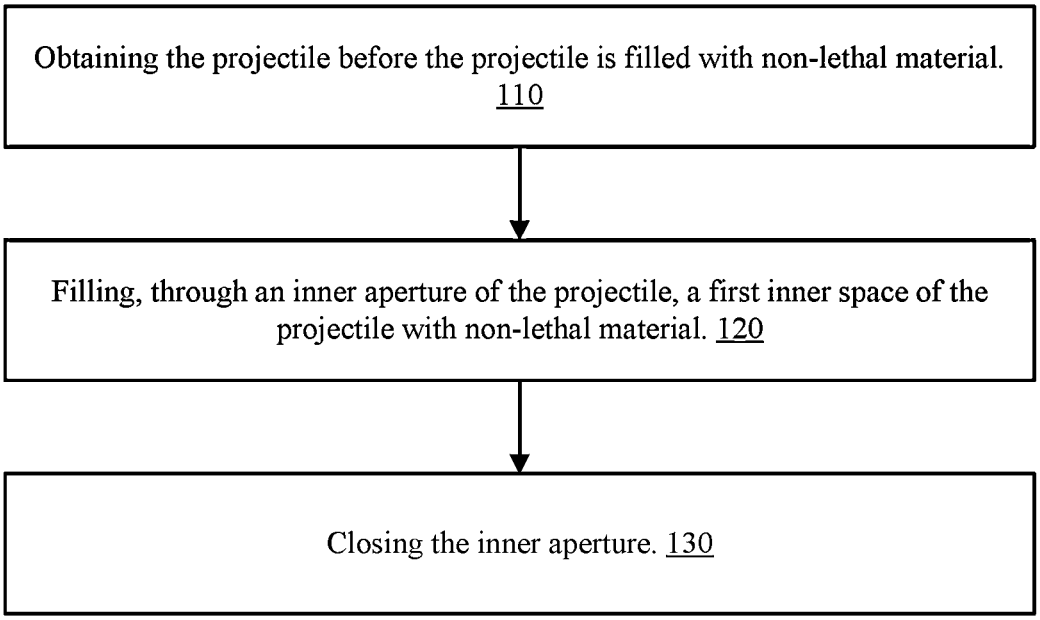
FIG. 8 is an example of a method.

FIG. 8 illustrated a method 100 for preparing a projectile for a non-lethal weapon.

Method 100 may start by step 110 of obtaining the projectile before the projectile is filled with non-lethal material.

Step 110 may be followed by step 120 of filling, through an inner aperture of the projectile, a first inner space of the projectile with non-lethal material.

Step 120 may be followed by step 130 of closing the inner aperture with a closing element.

Step 130 may include closing the inner aperture in any manner—for example—gluing (see for example glue 13 of FIG. 3) the closing element to the inner aperture, welding the closing element to the inner aperture, and the like.

The projectile may be any of the non-lethal projectiles mentioned in the specification and/or in FIGS. 1-7.

Any dimension illustrated in the figures is merely an example.

Some of the figures are shown without the cover and/or without the aperture—for simplicity of explanation only.

In the foregoing specification, the invention has been described with reference to specific examples of embodiments of the invention. It will, however, be evident that various modifications and changes may be made therein without departing from the broader spirit and scope of the invention as set forth in the appended claims.

Moreover, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermedial components. Likewise, any two components so associated can also be viewed as being "operably connected," or "operably coupled," to each other to achieve the desired functionality.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

We claim:

1. A projectile for a non-lethal weapon, the projectile comprises:

a hemispherical member;

an inner element that comprises an inner aperture;

a body that comprises a sidewall, wherein the sidewall comprises a front end that is adjacent to the hemispherical member and a rear end that is proximal to the hemispherical member; wherein the inner element is positioned between the front end and the rear end; wherein the inner aperture and the hemispherical member define a first inner space for receiving non-lethal material; and a closing element for closing the inner aperture.

2. The projectile according to claim 1 comprising the non-lethal material.

3. The projectile according to claim 1 wherein the rear end is open ended.

4. The projectile according to claim 1 wherein a front part of the closing element has a stepped cross section.

5. The projectile according to claim 4 wherein the inner aperture has a stepped cross section.

6. The projectile according to claim 1 wherein a front part of the closing element is radially symmetrical.

7. The projectile according to claim 6 wherein the inner aperture is radially symmetrical.

8. The projectile according to claim 1 wherein an interior of the hemispheric member comprises an inner step and wherein the inner element has a corresponding inner recess.

9. The projectile according to claim 1 comprising fins extending from the sidewall.

10. The projectile according to claim 1 wherein the closing element is a cover.

11. The projectile according to claim 1 wherein an inner element comprises a closing element interface for interfacing with the closing element, wherein the closing element interface is radially symmetrical.

12. The projectile according to claim 11 wherein the closing element interface has a bevel exterior and a stepped inner interior.

13. The projectile according to claim 12 wherein the closing element, when attached to the closing element interface, does not exceed the closing element interface.

14. The projectile according to claim 1 wherein the hemispherical member is connected to a body.

15. The projectile according to claim 1 wherein the hemispherical member is integrated with the body.

16. The projectile according to claim 1 wherein the hemispherical member is manufactured as a single part with the body.

17. The projectile according to claim 1 wherein the inner element is an apertured cross member.

18. A projectile for a non-lethal weapon, the projectile comprises:

a hemispherical member;

an inner element that comprises an inner aperture;

a body that comprises a sidewall, wherein the sidewall comprises a front end that is adjacent to the hemispherical member and a rear end that is proximal to the hemispherical member; wherein the inner element is positioned between the front end and the rear end; wherein the inner aperture and the hemispherical member define a first inner space for receiving non-lethal material;

a closing element for closing the inner aperture; and the non-lethal material;

wherein the projectile for a non-lethal weapon is prepared by:

filling, through the inner aperture of the projectile, the first inner space of the projectile with non-lethal material; and closing the inner aperture with a closing element.

19. A method for preparing a projectile for a non-lethal weapon, the method comprises:

filling, through an inner aperture of the projectile, a first inner space of the projectile with non-lethal material; and closing the inner aperture with a closing element;

wherein the inner aperture is formed in an inner element of the projectile;

wherein the first inner space is defined by the inner element and a hemispherical member of the projectile;

wherein the projectile further comprises a body that comprises a sidewall, wherein the sidewall comprises a front end that is adjacent to the hemispherical member and a rear end that is proximal to the hemispherical member; wherein the inner element is positioned between the front end and the rear end.

20. The method according to claim 19 wherein the filling occurs after the body and the hemispherical member are connected to each other.

21. The method according to claim 19 wherein the closing of the inner aperture comprising gluing the inner aperture to the closing element.

* * * * *